United States Patent [19]

Zielinski

[11] Patent Number: 4,579,047

[45] Date of Patent: Apr. 1, 1986

[54] FIRE DAMPER ASSEMBLY FOR SEALED PENETRATIONS

[75] Inventor: George E. Zielinski, Chicago, Ill.

[73] Assignee: Pullman Construction Industries, Inc., Chicago, Ill.

[21] Appl. No.: 681,908

[22] Filed: Dec. 13, 1984

[51] Int. Cl.[4] ..... F24F 11/00

[52] U.S. Cl. ..... 98/1; 160/1; 285/49; 285/158

[58] Field of Search ..... 98/1; 126/314; 160/1; 248/56; 285/49, 158, 192

[56] References Cited

U.S. PATENT DOCUMENTS

| | | | |
|---|---|---|---|
| 222,242 | 12/1879 | Campbell et al. | 126/314 |
| 327,321 | 9/1885 | Schevermann | 126/314 |
| 3,575,229 | 4/1971 | Alley | 98/1 X |

FOREIGN PATENT DOCUMENTS

| | | | |
|---|---|---|---|
| 604106 | 8/1978 | Switzerland | 98/1 |

*Primary Examiner*—Harold Joyce

*Attorney, Agent, or Firm*—Silverman, Cass & Singer

[57] ABSTRACT

A fire damper assembly, used in a heating, ventilating and air conditioning system, includes a sheet metal outer frame circumferentially surrounding a commercially available, rectangular fire damper. Angle iron retainers mounted interior of the outer frame and front and back of the fire damper retain the fire damper along the depth of the outer frame. The outer frame is intended to be sealed directly or in a sealed duct in a fire resistant wall opening or penetration provided for passage of air of the heating, ventilating and air conditioning system. The outer frame has a height and width sufficient to accommodate the height and width of the fire damper plus the required thermal expansion of the fire damper to insure its proper operation under the heat or increased temperature of a fire. The angle irons close the thermal expansion spaces to passage of air and fire. A sheet metal outer sleeve tightly engaged around the fire damper and resilient spacers secured to the outer sleeve in the expansion spaces interior of the outer frame protect the fire damper from seismic or other vibrational damage. The resilient spacers are folded strips of sheet metal each having a mounting tab at one end, and can flatten by extension along the sides of the outer sleeve to allow thermal expansion of the fire damper.

30 Claims, 8 Drawing Figures

FIG. 1
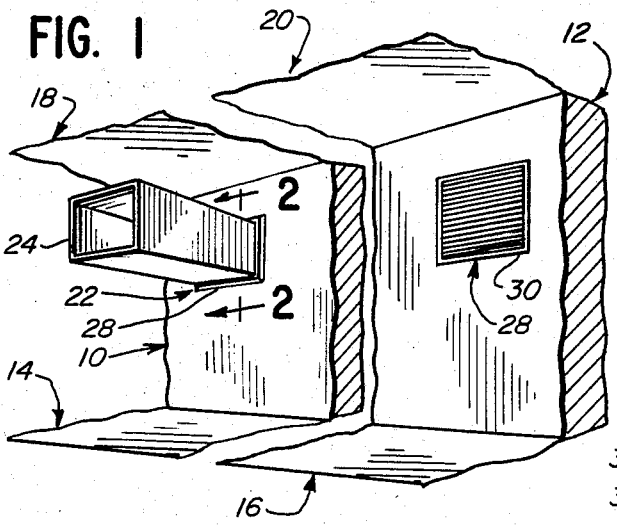
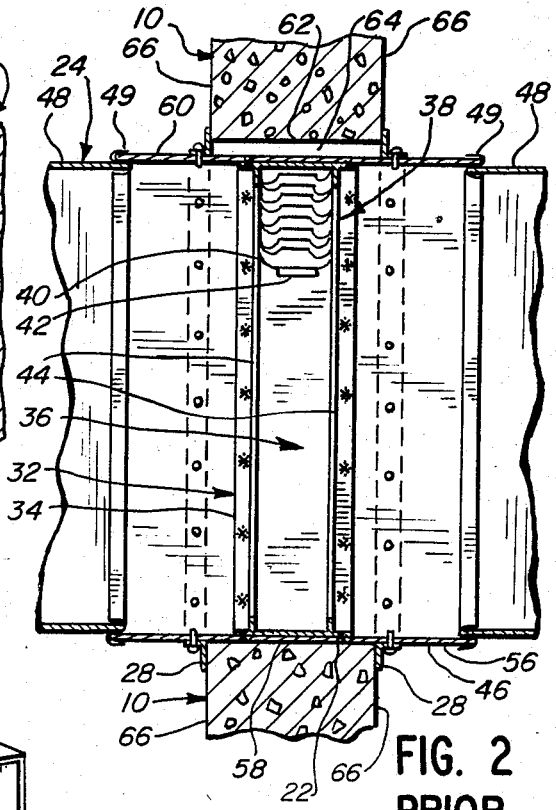
FIG. 2
PRIOR ART
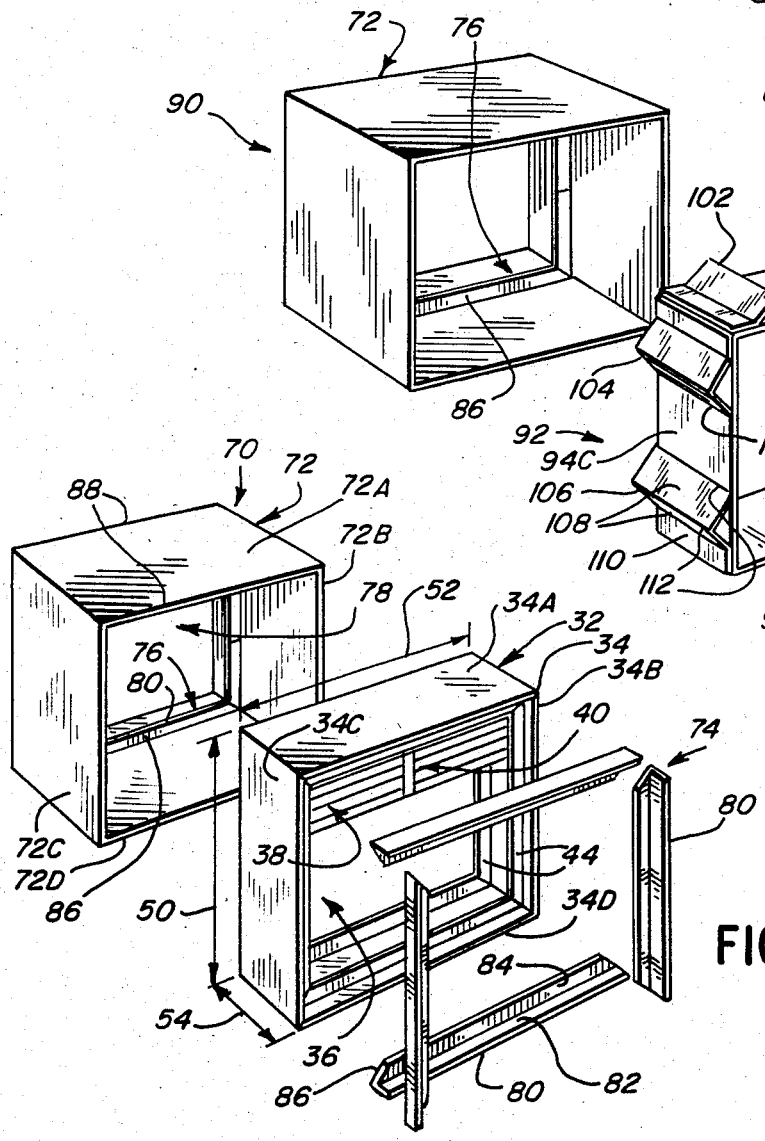
FIG. 3
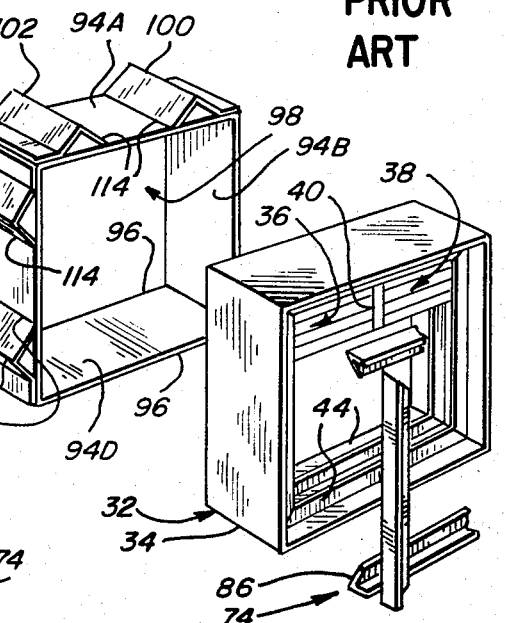
FIG. 4

FIG. 7
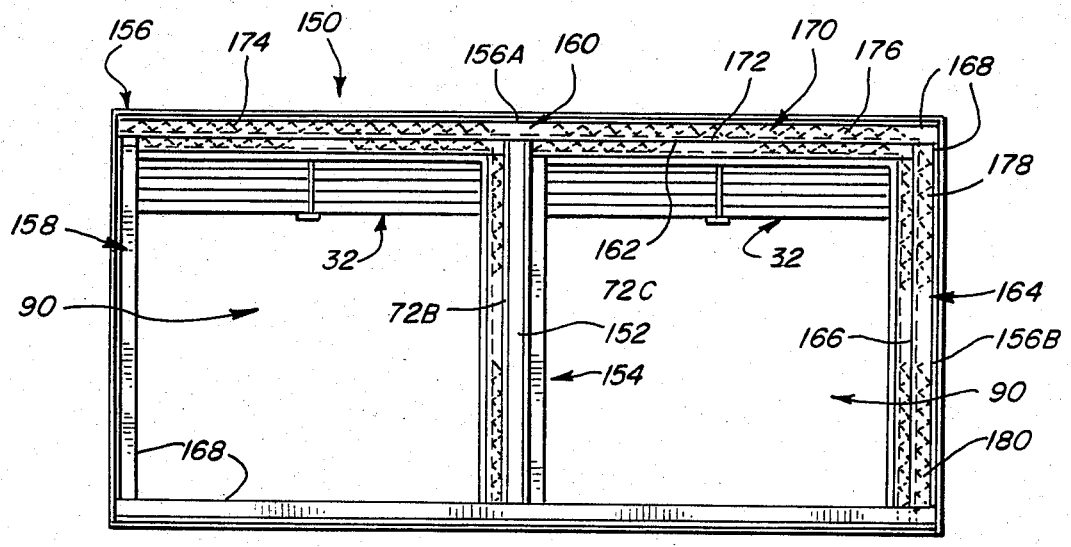
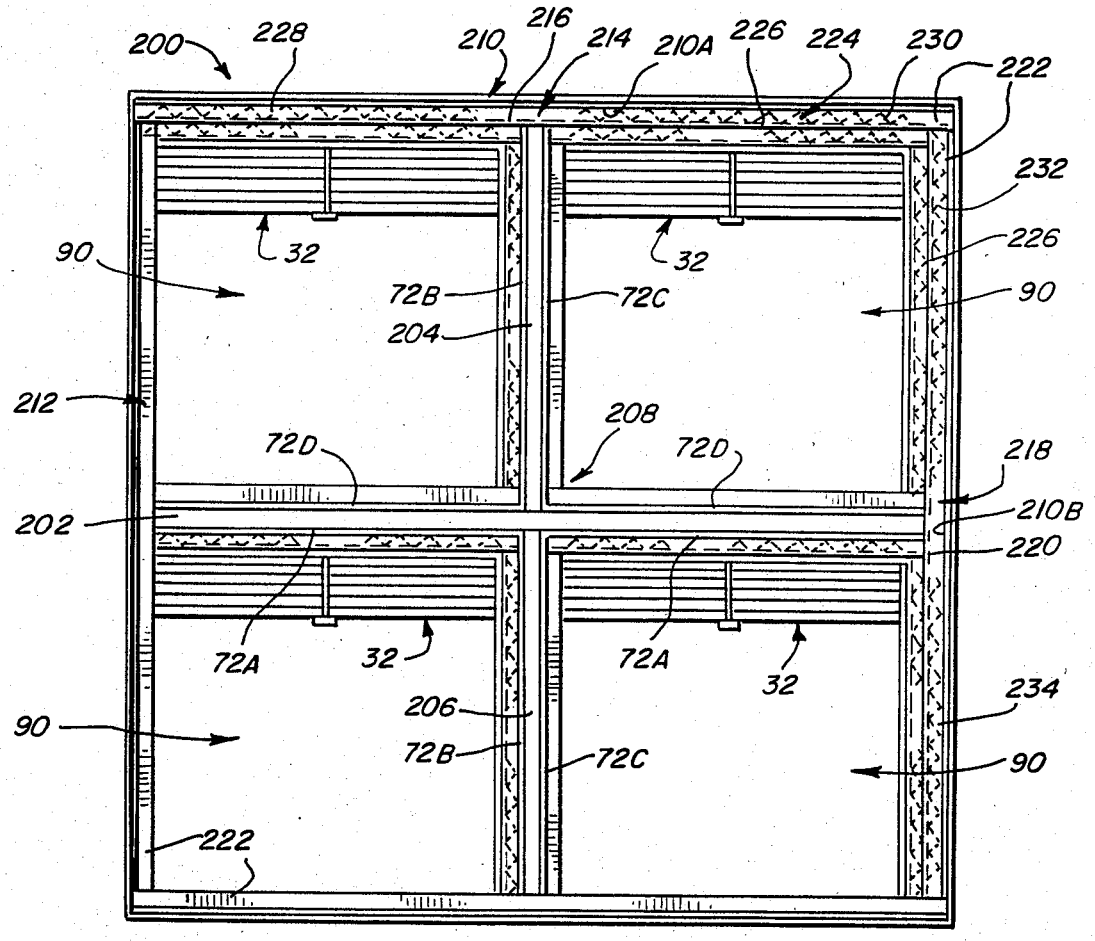
FIG. 8

FIRE DAMPER ASSEMBLY FOR SEALED PENETRATIONS

BACKGROUND OF THE INVENTION

This invention relates generally to fire dampers used in heating, ventilating and air conditioning systems at penetrations or openings through fire resistant walls, and particularly, to fire damper assemblies that are sealed in such wall penetrations.

Present fire prevention regulations require the presence of fire retardant walls throughout a building to prevent the spread of fire from one area of the building to another. These fire retardant walls include partitions between selected areas and floors and ceilings. Openings through these walls used for heating, ventilating and air conditioning are required to contain fire dampers, which normally provide free flow of air through the opening, but when activated by the heat of a fire, substantially close the opening. Ordinarily, sheet metal ducts containing the desired heating, ventilating and air conditioning air pass through these fire wall openings, but occasionally the duct is unnecessary and a clear passage opening through the wall is sufficient. When ducts are used, the fire damper is mounted interior of the duct at the opening through the wall. Otherwise, the fire damper is mounted directly in the wall opening.

Fire dampers, generally, are fabricated or formed of sheet metal to a box-like structure presenting a peripheral frame around a clear or open central passageway. Along one reach of the frame, interconnected sheet metal blades, louvers or baffles are held stored in place by a strap including a heat meltable link. A spring mechanism is connected to the blades so that when the link is melted by the heat of a fire, the spring mechanism positively moves the blades across the central passageway to close same. Another style of fire damper uses blades or louvers in a venetian blind arrangement to close the central passageway by rotation of the louvers upon melting of a link restraining a spring mechanism.

The blades and frame of the fire dampers are made of metal, usually a selected grade of steel, to withstand the high temperatures of a fire, while functioning to prevent the fire from passing through the barrier presented thereby. These high temperatures cause the parts of the fire damper to expand. Accordingly, installation of the fire damper in the wall opening requires an expansion space peripheral of the fire damper to insure proper operation of the blades when they are expanded by the heat. The expansion space is provided by cutting the wall opening larger than the fire damper height and width and using circumferential mounting flanges or collars to close off the expansion space otherwise providing another circumferential passage through the fire wall. In a duct mounting, the expansion space is exterior of the duct.

In certain critical buildings, such as nuclear power plants, the fire regulations recently have been changed to require sealing all wall penetrations with such as concrete, masonry or mineral fibers. Thus, the existing expansion spaces around fire dampers are being filled to seal the space around the fire damper, or the duct containing the interior mounted fire damper. Previously, this sealing had occurred in many locations, contrary to the manufacturers specifications. This possibly renders the fire dampers useless, thermal expansion of the parts without compensation can cause the blades to jam in the frame without completely closing off the central passageway. Such a possibility of fire damper non-operation is unacceptable in any environment, nuclear power plant or commercial office building. Thus, a fire damper is needed that can be sealed in the penetration through a fire wall without requiring an external expansion space.

Additionally, nuclear power plant regulations require that the building components, including fire dampers, survive or operate through severe seismic conditions, such as an earthquake. Thus, the fire damper mechanism must also be positively restrained to prevent its sheet metal parts from being battered to a non-operable condition by its unrestrained movement.

These requirements are equally applicable to commercial office space and nuclear power plant environments.

SUMMARY OF THE INVENTION

In accordance with the invention, a fire damper assembly includes an outer frame circumferentially surrounding the rectangular frame of a fire damper. The outer frame is adapted to be sealed in a penetration through a fire wall while retaining the fire damper in the penetration. The outer frame accommodates thermal expansion of the fire damper caused by the heat of a fire, and includes portions blocking the passage of air and fire through expansion spaces between the fire damper and outer frame.

The fire damper used in the invention has a four-sided, rectangular, sheet metal frame circumferentially surrounding a passageway therethrough. A plurality of blades, or louvers or interconnected baffles are arranged in the damper frame to be moved across the passageway to close or block the passage of air and fire through the passageway upon melting of a fusible link in a fire. The damper can have the blades arranged stored along one side, in a venetian blind arrangement, and otherwise as desired. The fire damper requires expansion spaces along its height and width dimensions. This insures proper operation by avoiding jamming of the blades in the frame caused by thermal expansion of the fire damper components in a fire. The fire damper has a depth along the direction of air passage through the passageway.

The outer frame has four, sheet metal sides rectangularly formed to circumferentially surround a passageway therethrough. The outer frame, although formed of sheet metal that expands under heat of a fire, requires no exterior expansion space to insure proper operation of the assembly. The outer frame, thus, can be sealed in a penetration or opening through a fire wall, or it can be installed flush interior of a duct, the exterior of which is sealed in a penetration through a fire wall.

The outer frame has a height at least as large as the sum of the fire damper height plus the required fire damper height expansion space or distance. Further, the outer frame has a width at least as large as the sum of the fire damper width plus the required fire damper width expansion space or distance. The expansion spaces are defined by the horizontal and vertical expansion distances and the depth of the outer frame. The depth of the outer frame is greater than the depth of the fire damper. This provides space on both front and back sides of the outer frame on which to secure retainers, such as angle irons, to retain the fire damper in the outer frame. The angle irons have heights extending inwardly of the outer frame sufficiently to close, blind or block passage of air and fire through the expansion spaces between the fire damper and outer frame.

The outer frame thus retains the fire damper loosely therein. The damper is free to move into the height and width expansion spaces between it and the outer frame and is slidingly retained along the depth of the outer frame by the inwardly extending angle iron retainers.

The damper's free movement along the height and width of the outer frame, such as could render the damper inoperable under severe seismic conditions, can be substantially eliminated by additional resilient spacer means structure of the assembly. First, a tight fitting sleeve engaged around the exterior of the damper reinforces the damper frame. Second, a pair of resilient spacers are fixed exterior the sleeve in each of the height and width expansion spaces interior of the outer frame. The resilient spacers engage both the outer frame and the sleeve to restrain movement of the fire damper caused by seismic vibration or other forces. The resilient spacers additionally are constructed and arranged to compress and accommodate thermal expansion of the fire damper to insure its proper operation. The resilient spacers, in the preferred embodiment, are strips of sheet metal bent in an open accordian form with a flat mounting tab at one end to facilitate their being mounted to the reinforcing sleeve. Such an arrangement is specially suited for a nuclear power plant environment.

Large penetrations through fire resistant walls require multiple fire dampers, and the invention provides for these situations. A double fire damper arrangement or assembly is obtained by joining, such as by welding, two of the described fire damper assemblies to a center, metal mullion. This dual joined structure then is installed in a second outer rectangular frame circumferentially surrounding the joined structure and having height and width expansion spaces sufficient to accommodate the thermal expansion of the joined structure. Front and back mounted angle irons retain the dual joined structure in the second outer frame. Seismic or other vibrational protection is obtained by installing pairs of additional resilient spacers between a second sleeve engaged around the joined structure and the second outer frame. The second frame then can be sealed in the fire wall penetration directly or interior of a duct sealed in the penetration.

A quadruple fire damper arrangement or assembly is obtained by fixing four of the first described fire damper assemblies to center mullions and a cross bar. This quad joined structure then is installed in another second, rectangular outer frame circumferentially surrounding the joined structure and having height and width expansion spaces sufficient to accommodate the thermal expansion of the quad joined structure. Front and back mounted angle irons retain the quad structure in the other second outer frame. Again, seismic or other vibration protection is obtained by installing additional pairs of resilient spacers between another sleeve engaged around the quad structure and the other second outer frame. The other second outer frame then can likewise be sealed in the fire wall penetration directly or interior of a duct sealed in the penetration.

BRIEF DESCRIPTION OF THE DRAWING

FIG. 1 is a perspective view of sections of fire resistant walls having penetrations therethrough for normal passage of air;

FIG. 2 is a partial sectional view of a prior fire damper assembly taken along the line 2—2 of FIG. 1 in the direction indicated by the arrows;

FIG. 3 is an exploded perspective view of a fire damper assembly of the invention;

FIG. 4 is an exploded perspective view of a fire damper assembly of the invention including vibration protection;

FIG. 7 is a front elevation view of a plural fire damper assembly having two fire dampers; and FIG. 8 is a front elevation view of a plural fire damper assembly having four fire dampers.

DESCRIPTION OF THE PREFERRED EMBODIMENT

Figure 6:
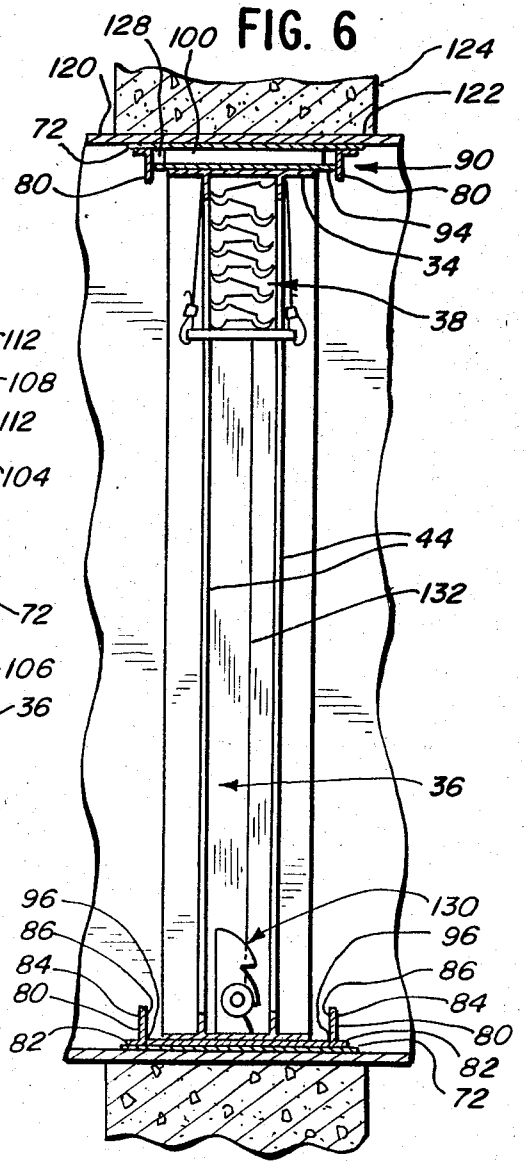
FIG. 6 is a sectional view of the fire damper assembly take along the line 6—6 of FIG. 5 in the direction indicated by the arrows.

Referring to FIG. 1, fire resistant walls 10 and 12 extend between floors 14 and 16 and ceilings 18 and 20 to form barriers resistant to passage of fire.

Wall 10 includes a penetration 22 therethrough for normal passage of air in such as a heating, ventilating and air conditioning system. A rectangular sheet metal duct 24 passes through penetration or opening 22 and a circumferential collar 26 surrounds duct 24 at the entrance to penetration 22. Alternatively, a penetration 28 in wall 12 can be free of an unnecessary air containing duct of a heating, ventilating and air conditioning system and can be covered simply with a grill or grating 30. In both cases, a fire damper must be provided in the penetrations 22,28 through the fire walls to prevent the spread of fire therethrough.

Referring to FIG. 2, a present fire damper 32 is installed interior of duct 24 in wall 10. Referring also to FIGS. 3 and 4, fire damper 32 comprises a rectangular frame 34 having four sides 34A, 34B, 34C and 34D that is open front and back to define a circumferentially surrounded passageway 36 for normal passage of heating, ventilating and air conditioning air therethrough. A plurality of interconnected blades, louvers or baffles 38 are held stored near the top of the firedamper by a strap 40 including a fusible link 42. Under the heat or increased temperature of a fire, typically at 165° F., the link 42 will melt, opening the strap 40 and enabling the blades 38 to fall down under gravity force between raised lips 44 to close, blind or form a barrier in passageway 36.

Other styles of fire dampers are known that use blades in a venetian blind arrangement to close the passageway upon melting of a similar link. Additionally, the fire damper can include a spring or springs positively to move the blades to close the passageway upon the melting of the link. The fire damper illustrated is commercially available from Air Balance, Inc. of Westfield, Mass. as Model 319ALV.

In FIG. 2, fire damper 32 is welded to the interior of a duct sleeve 46. The duct sleeve 46 is installed in the penetration 22 with the fire damper 32 centrally located in penetration 22. Collars 28 are rivited to duct sleeve 46 to retain sleeve 46 in its relative position in penetration 22. Duct extensions 48 are joined to duct sleeve 46 at seams 49.

Referring back to FIG. 3, fire damper 32 has a height, width and depth indicated respectively by arrows 50,52 and 54. The manufacturer's requirements for installation of the fire damper include having an expansion clearance from the fire wall, in the penetration, along both the height and width dimensions of the fire damper. Typically, the clearance is specified for each dimension to be ½ inch plus ⅛ inch per linear foor of fire damper. A fire damper having a height of one (1) foot then requires $\frac{1}{2}'' + \frac{1}{8}'' = \frac{5}{8}''$ expansion space along its height dimension. The clearance or space requirement is across the depth of the fire damper in the height direction. The width expension space is similarly calculated. This expansion space is required to compensate for the themal expansion of the fire damper under the increased temperature of a fire and to insure proper operation of the damper to close passageway 36.

In FIG. 2, the bottom side surface 56 of duct sleeve 46 rests under force of gravity on the surface 58 of wall 10 forming the bottom of penetration 22. The top side surface 60 of duct sleeve 46 is spaced from the surface 62 of wall 10 forming the top of penetration 22 to provide a void or height expansion space 64 required to compensate for thermal expansion of fire damper 32 and duct sleeve 46. The distance between wall surfaces 58 and 62 is selected to accommodate or be at least as large as the height of fire damper 32 plus the required height expansion distance plus the thickness of the material of the duct sleeve 46.

Although not shown, the required width expansion space for fire damper 32 is provided in a manner similar to that providing for the height expansion space. The surfaces of wall 10 defining the width of penetration 22 are spaced apart a distance selected to accommodate or be at least as large as the width of fire damper 32 plus the required width expansion distance plus the thickness of the material of sleeve duct 46.

Under normal operating conditions, then, the duct sleeve 46 and interior fire damper 32 are free to move vertically and horizontally in penetration 22 the distances provided by the required respective height and width expansion spaces. The duct sleeve and fire damper are retained in penetration 22 along the depth of fire damper 32 by the collars 28 sliding along the outer surfaces 66 of wall 10. The fire damper manufacturer typically specifies that the collars 28 be increased peripherally in size so that there will be a minimum one (1) inch overlap of the collars 28 on the wall surfaces 66. This overlap is required to close the expansion spaces such as 64 from passing air and fire therethrough.

A wall penetration, such as 30 of FIG. 1, includes a similar installation, construction and arrangement providing expansion spaces peripheral of the interior fire damper.

Previously, the expansion spaces often were filled inadvertently with fire resistant material to prevent the passage of fire between the wall penetration surfaces and the duct sleeve outer surfaces, i.e., through the expansion spaces. More recently, fire codes have changed to require that all wall penetrations be sealed. Previously, the fire codes allowed the expansion spaces described to be free of material. In either case, the manufacturer's required expansion space presently is unavailable, raising the possibility of improper fire damper operation, i.e. a partial closing of the passageway 36 by jammed blades 38, or non-operation i.e., no closing of passageway 36 by jammed blades 38, in a fire due to thermal expansion of the fire damper components. This is unacceptable in insuring the containment of a fire.

In FIG. 3, the fire damper assembly of the invention is indicated generally by the reference character 70. Fire damper assembly 70 comprises fire damper 32, outer frame 72 and retainer means 74 and 76. Fire damper 32 is the commercially available fire damper previously described. Outer frame 72 has four sheet metal sides, 72A, 72B, 72C and 72D, rectangularly arranged to be open front and back and define a circumferentially surrounded passageway 78 therethrough. The outer surfaces of sides 72A, 72B, 72C and 72D are adapted to be sealed to the surfaces interior of a duct or the wall surfaces defining a fire wall penetration.

Outer frame 72 is dimensioned to have a height in passageway 78 that accommodates or is at least as large as the height and required height expansion space of fire damper 32. Outer frame 72 also is dimensioned to have a width in passageway 78 that accommodates or is at least as large as the width and required width expansion space of fire damper 32. Lastly, outer frame 72 has a depth along passageway 78 that is greater than the depth of fire damper 32.

Reference to the height, width and depth of the outer frame 72 refers to the like dimensions earlier specified for fire damper 32.

Fire damper 32 is installed in passageway 78 of outer frame 72 with its four sides 34A–34D juxtaposed the four sides 72A–72D of the outer frame and the passageways 36 and 78 are aligned with one another.

Fire damper 32 is retained in outer frame 70 by retainer means 74 and 76. The retainer means 74 and 76 comprise two sets of four angle iron members 80 secured to the outer frame 72 interior of passageway 78 at the front and back sides of the fire damper. Each angle iron member 80 has a base portion 82 that is secured to the outer frame and an upstanding barrier portion 84 arranged to extend inwardly of the passageway 78 a distance greater than the expansion height and width provided between fire damper 32 and outer frame 72. Each barrier portion 84 presents a side surface 86 against which the fire damper can slide to maintain the fire damper centered in the depth of the outer frame 72 or passageway 78. Members 80 extend around the inner circumference of outer frame 72 at the margins or edges 88 thereof.

Reference to the height, width and depth of the outer frame 72 refers to the like dimensions earlier specified for fire damper 32.

Retainer means 74 and 76 thus perform the three functions of retaining the fire damper in the outer frame; blocking the passage of air and fire through the expansion spaces between the fire damper and outer frame; and performing these first two functions while the fire damper expands under the heat of a fire.

Fire damper assembly 70 thus provides a structure that can be flush mounted into a fire wall penetration and can be sealed therein to meet present fire codes. Upon proper selection of the fire damper and outer frame dimensions, assembly 70 can replace existing fire dampers in situations where the external expansion spaces were inadvertently filled or must now be filled to meet present code requirements. The fire damper assembly of the invention avoids the possibility of improper or non-operation of the fire damper by providing the required expansion spaces interior of the framing member to be sealed into the fire wall.

An existing penetration need not be enlarged to accept the fire damper assembly of the invention. Rather, the existing fire damper can be removed and the fire damper assembly 70 can be installed in its place with minimal labor and minor disruption of service.

Certain building installations, such as nuclear power plants, require additionally that the fire damper operate properly under severe seismic conditions, such as an earthquake. In such conditions, severe building vibrations could batter a free floating fire damper sufficiently to render it partially or totally inoperable, i.e. the sheet metal frame and blades of the fire damper can be bent or twisted to an improper configuration. There is accordingly a requirement that fire dampers in such installations be capable of proper operation after such seismic or other induced vibration.

The invention herein provides for this requirement with fire damper assembly 90 of FIG. 4. Assembly 90 comprises outer frame 72, fire damper 32, retainer means 74 and 76 and resilient spacer means 92. Assembly 90 thus includes all of the structure and features of assembly 70 plus resilient spacer means 92.

Resilient spacer means 92 comprise a sleeve 94 of sheet metal having sides 94A, 94B, 94C and 94D to be tightly engaged around the respective sides of fire damper 32. Sleeve 94 has a depth slightly greater than the depth of fire damper 32 so that the front and back edges 96 of sleeve 94 slide against the side surfaces 86 of the retainer means 74 and 76. Sleeve 94 functions to strengthen fire damper 32 and to space the fire damper from the retainer means 74 and 76. When assembled to sleeve 94, fire damper 32 is welded along its edges to the interior of sleeve 94. Sleeve 94 defines a passageway 98 therethrough.

Exterior of sleeve 34 there are a plurality of resilient spacers 100,102, 104 and 106. The spacers are arranged in two pairs, one pair each secured on side 94A and 94C of sleeve 94. Each spacer is formed from a strip of sheet metal bent to have a plurality of leaves 108 in a corrugated form or an open accordian fold and a terminal mounting tab 110. There can be as many leaves as are desired even though only two leaves are illustrated in FIG. 4. Tabs 110 are fixed to the exterior of sleeve 94 by such as spot welding so that the ends of the spacers are fixed to the sleeve and the leaves are feee to extend and retract along the sides of the sleeve. The spacers have widths no greater than the depth of sleeve 94.

Fire damper 32 with resilient spacer means 92 engaged therearound is installed intrior of outer frame 72. The resilient spacers 100, 102, 104 and 106 are arranged to be in the height and width expansion spaces between the outer frame 72 and damper 32. Alternating creases, bends or fold lines 112 between the leaves 108 are arranged to engage against the interior of outer frame 72 and the exterior of sleeve 94. When assembly 90 is completed, the spacers then may be described as being secured in the expansion spaces.

With such position and engagement, the spacers 100, 102, 104 and 106 function to restrain fire damper 32 fixed in position in the assembly 90 to prevent the damper from being damaged under vibrational stress. The folds 112 between the leaves of the resilient spacers serve as springs to absorb excess vibrational energy and maintain damper 32 in operational condition. Thus damper 32 is not battered interior of frame 72 under seismic or other vibrational stress.

Additionally, under the increased temperature of a fire and the thermal expansion of the fire damper 32, the sleeve 94 expands at approximately the same rate as the fire damper and the spacers 100, 102, 104 and 106 flatten by extending along the sleeve sides, allowing full thermal expansion of the fire damper 32. This insures proper operational condition for the fire damper 32. This further occurs even under simultaneous vibrational conditions. The spacers are formed so that even when fully extended under severe thermal conditions, their ends 114 will not abut but will be spaced from one another.

Figure 5:
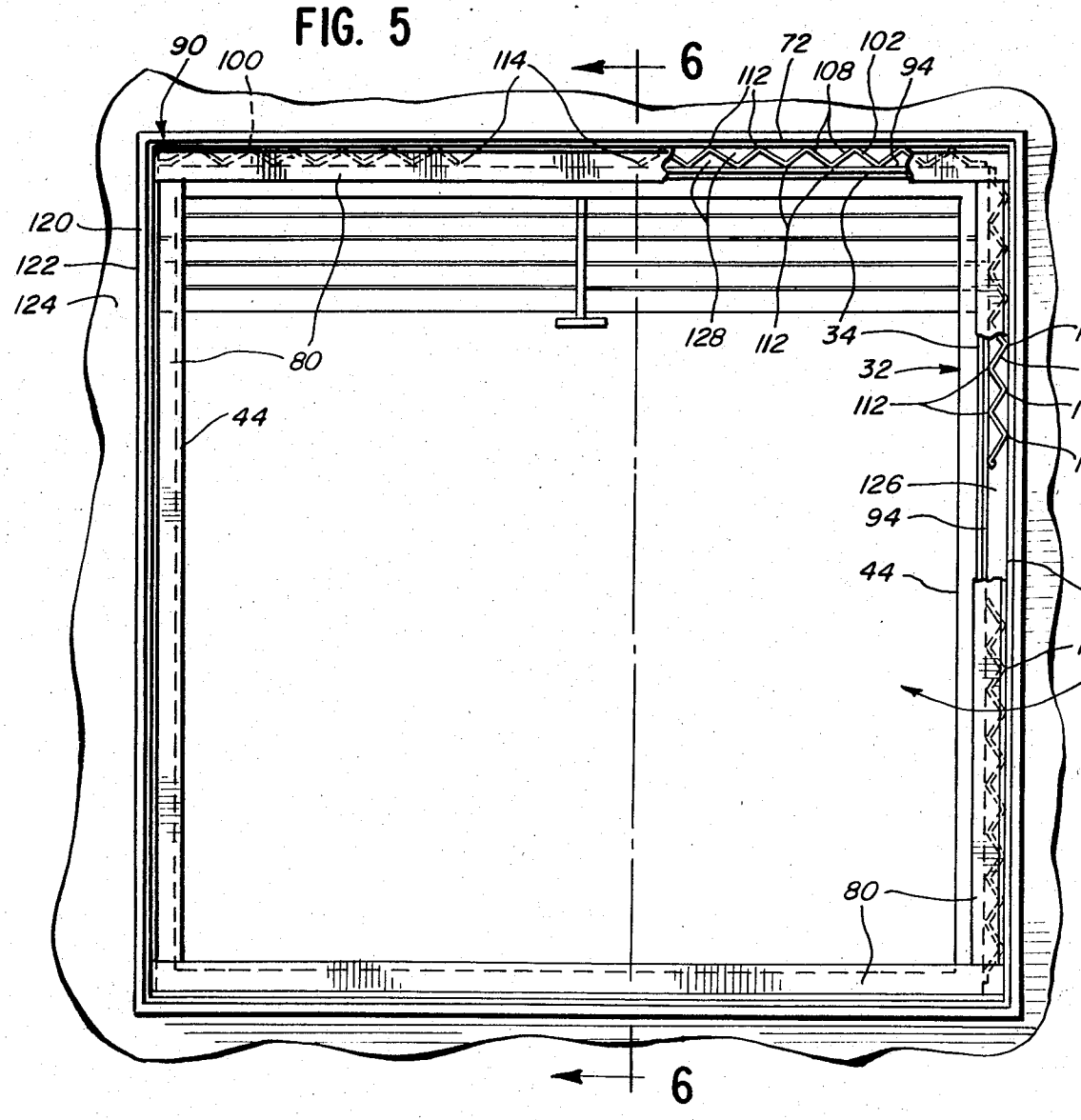
FIG. 5 is a front elevation view of the fire damper assembly of FIG. 4 installed in a fire wall penetration.

In FIGS. 5 and 6, the assembly 90 is installed interior of a rectangular sheet metal duct 120 circumferentially sealed in a penetration 122 through a fire resistant fire wall 124. The fire damper 32 is biased to the bottom left of the outer frame leaving the width expansion space 126 at the right and the height expansion space 128 at the top of the fire damper. Spacers 100 and 102 are secured in the height expansion space 128 and alternating folds 112 of the spacers are engaged respectively against the outer sleeve 94 and the outer frame 72. The ends 114 of the resilient spacers are spaced apart sufficiently to allow flattening free of abutting. The outer sleeve 94 is tightly engaged around the outer frame 34 of damper 32.

Spacers 104 and 106 are secured in the width expansion space 126 and alternating folds 112 of the spacers are engaged respectively against the outer sleeve 94 and the outer frame 72. The ends of the spacers are spaced apart sufficiently to allow extension of ths spacers without abutting. The members 80 extend into passageway 36 through damper 32 sufficiently to close the expansion spaces to passage of air and fire.

Sleeve 94 has a depth greater than fire damper frame 34 and the front and back edges of sleeve 96 engage against the sliding surfaces 86 of upstanding barrier portions 84 of members 80. Base portions 82 are secured to outer frame 72.

Latching spring mechanism 130 acts by way of band 132 positively to draw the blades 38 across passage 36 between lips 44 to close same.

The invention thus provides an outer box comprising outer frame 72 and retainer means 74 and 76 circumferentially around fire damper 32. The outer box is intended to be sealed in the fire wall penetration or duct therethrough and provide adequate space for thermal expansion of the fire damper. Resilient spacers restrain the fire damper from possibly damaging movement in the outer box while the spacers are able to flatten to accommodate expansion of the fire damper. The spacers additionally reduce possibly annoying rattle of the fire damper in the outer box caused by normal operating machinery vibration. Assemblies having plural or multiple fire dampers can have these same qualities.

In FIG. 7, plural fire damper assembly 150 comprises two fire damper assemblies 90 arranged side by side. Their adjacent outer frame sides, such as 72B and 72C, are joined to a center mullion 152 by such as welding to form a joined structure 154. Joined structure 154 requires thermal expansion spaces at its height and width to insure proper operation of the fire dampers 32.

In accordance with the invention, the plural fire damper assembly 150 also comprises a second outer frame 156, circumferentially surrounding the joined structure 154, and retaining means 158 for retaining the joined structure 154 therein front and back. The second outer frame is dimensioned along its height to accommodate the height of the joined structure plus the joined structure's required height expansion space, and along its width to accommodate the width of the joined structure plus the joined structure's required width expansion space. Thus, there is a height expansion space 160 between the top surface 162 of joined structure 154 and interior the top side 156A of the second outer frame 156. A width expansion space 164 lies between the right side surface 166 and interior the second outer frame side 156B. Retainer means 158 comprising angle iron members 168, extend circumferentially interior of the second outer frame 156 to retain the joined structure therein. In all respects, the angle iron members 168 are similar in function, location and construction to members 80.

Additionally, assembly 150 includes second resilient spacer means 170 arranged in the height and width expansion spaces 160 and 164. Second resilient spacer means 170 include a second outer sleeve 172 circumferentially engaged about the joined structure 154 to reinforce same and resilient spacers 174, 176, 178 and 180. Resilient spacers 174–180 are similar to spacers 100–106 in all regards and are engaged between the interior of second outer frame 156 and the exterior of second outer sleeve 172 for the same purposes and functions as spacers 100–106.

Similar to the single fire damper assembly 90, plural fire damper assembly 150 provides a second outer frame and retainer means 158 forming a second outer box intended to be sealed in a fine wall penetration or to be installed interior of a duct through such a penetration. This second outer box circumferentially surrounds an inner joined structure and provides adequate expansion space for it, the joined structure comprising two fire damper assemblies, each providing thermal expansion space for its circumferentially surrounded fire damper. Resilient spacer means reinforce the inner components and restrain the inner joined structure from possibly damaging movement in the second outer box while the spacers can flatten to accommodate thermal expansion of the inner joined structure.

In FIG. 8, plural fire damage assembly 200 comprises four fire damper assemblies 90 arranged in side by side relationship. Their adjacent sides, such as 72A, 72B, 72C and 72D, are joined to a cross bar 202 and a pair of vertically extending mullions 204 and 206 by such as welding to form a joined structure 208. Joined structure 208 requires thermal expansion spaces at its height and width to insure proper operation of the four fire dampers 32.

In accordance with the invention, the plural fire damper assembly 200 also comprises a second outer frame 210 circumferentially surrounding the joined structure 208 and retaining means 212 for retaining the joined structure 208 therein front and back. The second outer frame is dimensioned along its height to accommodate the height of the joined structure plus the joined structure's required height expansion space, and along its width to accommodate the width of the joined structure plus the joined structure's required width expansion space. Thus, there is a height expansion space 214 between the top surface 216 of joined structure 208 and interior the top side 210A of the second outer frame 210. A width expansion space 218 lies between the right side surface 220 and interior the second outer frame side 210B. Retainer means 212 comprising angle iron members 222, extend circumferentially interior of the second outer frame 210 to retain the joined structure therein. In all respects, the angle iron members 222 are similar in function and construction to members 80.

Additionally, assembly 200 includes second resilient spacermeans 224 arranged in the height and width expansion spaces 214 and 218. Second resilient spacer means 224 include a second outer sleeve 226 circumferentially engaged about the joined structure 203 to reinforce same and resilient spacers 228, 230, 232 and 234. Resilient spacers 228–234 are similar to spacers 100–106 in all regards and are engaged between the interior of second outer frame 210 and the exterior of second outer sleeve 226 for the same purposes and functions as spacers 100–106.

Similar to the single fire damper assembly 90, plural fire damper assembly 200 provides a second outer frame and retainer means forming a second outer box intended to be sealed in a fire wall penetration or to be installed interior of a duct through such a penetration. This second outer box circumferentially surrounds an inner joined structure and provides adequate expansion space for it, the joined structure comprising four fire damper assemblies, each providing thermal expansion space for its circumferentially surrounded fire damper. Resilient spacer means reinforce the inner components and restrain the inner joined structure from possibly damaging movement in the second outer box while the spacers can flatten to accommodate thermal expansion of the inner joined structure.

In a like manner, plural fire damper assemblies including any number of fire dampers can be fabricated in accordance with the principles of the invention. The outer frames of the individual fire damper assemblies can be joined together in side by side arrangement to form a joined structure. The joined structure then is circumferentially surrounded interior of a second outer frame and retainer means. The second outer frame is adapted to be sealed in a fire wall penetration and provide the joined structure with sufficient space for thermal expansion under the heat or high temperature of a fire. Resilient spacers mounted in the expansion spaces on an outer sleeve protect against vibration damage.

Modifications of the described structures while maintaining the invention are possible. Approximately square outer frames, frames and sleeves have been described. These can be changed to other rectangular shapes by changing the dimensions of the sides. Presently only square or rectangular fire dampers are available, and the described structures are drawn accordingly. Alternate geometrics for the fire damper can be accommodated within the invention by the circumferential enclosure of the fire damper with an outer frame intended to be sealed in a fire wall penetration, providing adequate spaces for expansion of the fire damper and closing the expansion spaces to passage of air and fire.

Resilient spacers and sleeves other than those specifically shown are possible. For example, the resilient spacers can be bowed spring members with no folds or they can be coil springs, in which case the respective expansion spaces are great enough to accommodate the thermal expansion of the inner structure plus the compressed volumes of the coil springs. The outer sleeves can be eliminated by otherwise strengthening the fire damper frame.

The retainer means can be other than the separate angle irons cut to length and installed in place. For example, the outer frame can have raised lips rolled in place while the outer frame is in a flattened condition. When the outer frame is bent into desired shape around the fire damper, the lips form the required retainer means. Further, the outer frame can be made of channel stock with the opposed, upstanding marginal walls forming the retaining means.

Modifications and variations of the present invention then are possible in light of the above teachings. It is therefore to be understood that within the scope of the appended claims, the invention can be practiced otherwise than as specifically described.

I claim:

1. A plural fire damper assembly adapted for sealed mounting in a penetration through a fire resistant wall, the assembly blocking passage of fire through said penetration and including vibration protection, said plural fire damper assembly comprising:

A. a plurality of fire dampers, each having a four sided, rectangular, sheet metal frame that is open front and back to define a circumferentially surrounded passageway for normal passage of air therethrough, there being a plurality of blades within the frame arranged to close the passageway to passage of air and fire therethrough upon melting of a link under heat of fire, each damper having a height and width and requiring expansion spaces along its height and width to accommodate thermal expansion of its components and insure complete closing of the passageway by the blades in the heat of a fire;

B. a first outer frame for each fire damper, each first outer frame having four sheet metal sides formed in a rectangular arrangement that is open front and back to define a circumferentially surrounded passageway therethrough, each said first outer frame having a height accommodating the height and required height expansion space of its respective fire damper and having a width accommodating the width and required width expansion space of its respective fire damper, each fire damper being installed in the passageway of its respective first outer frame with the four sides of the fire damper being juxtaposed the four sides of the first outer frame and the passageways therethrough being aligned with one another;

C. first retainer means secured to each of said first outer frames for retaining each fire damper within its respective first outer frame while blocking the passage of air and fire through the expansion spaces between the fire damper and first outer frame and accommodating expansion of each fire damper into said expansion spaces under heat of a fire;

D. first resilient spacer means located in said height and width expansion spaces between each said fire damper and first outer frame for limiting movement of said fire damper in said outer frame otherwise induced by vibration while accommodating thermal expansion of said fire damper into said expansion spaces;

E. said first outer frames being joined together to form a joined structure having said fire dampers in side by side rectangular arrangement, said joined structure having a height and a width and requiring expansion spaces along its height and width to accommodate thermal expansion of its components and insure complete closing of each fire damper passageway by the blades in the heat of a fire;

F. a second outer frame having sheet metal sides formed in a rectangular arrangement that is open front and back to define a circumferentially surrounded passageway therethrough, said second outer frame being adapted to be sealed in the penetration and having a height accommodating the height and required height expansion space of said joined structure and having a width accommodating the width and required width expansion space of said joined structure, the joined structure being installed in the passageway of the second outer frame with the sides of the joined structure juxtaposed the sides of the second outer frame and the passageways therethrougn being aligned with one another, G. second retainer means secured to said second outer frame for retaining said joined structure within the second outer frame while blocking the passage of air and fire through the expansion spaces between the joined structure and the second outer frame and accommodating expansion of the joined structure into said expansion spaces under heat of fire; and H. second resilient spacer means located in said height and width expansion spaces between said joined structure and said second outer frame for limiting movement of said joined structure in said second outer frame otherwise induced by vibration while accommodating thermal expansion of said joined structure into said expansion spaces.

2. The plural fire damper assembly of claim 1 in which said first and second retainer means include members secured to said respective outer frames, each said member including a base portion secured to the side surface of said outer frame and a barrier portion arranged to extend inwardly of said outer frame and into said outer frame passageway a distance greater than the expansion width and height provided thereat, the barrier portion having a side surface against which said fire damper and first outer frame, respectively, can slide while maintaining said respective fire damper and first frame in position along the depth of the passageways through said outer frames, said members extending around the inner circumference of said outer frames.

3. The plural fire damper assembly of claim 1 in which said first and second retainer means include angle irons.

4. The plural fire damper assembly of claim 1 in which said first and second resilient spacer means include a plurality of resilient spacers each formed from a strip of sheet metal bent into an open accordian fold and having an end mounting tab, there being a pair of resilient spacers secured in each expansion space and each resilient spacer having at least one bridge portion bridging the expansion space with the two opposed margins of the bridge portion engaging the respective fire damper and first outer frame, and the respective joined structure and outer frame.

5. The plural fire damper assembly of claim 4 in which said first resilient spacer means include a first sleeve of sheet metal circumferentially engaged around said fire damper to reinforce said fire damper, and said second resilient spacer means include a second sleeve of sheet metal circumferentially engaged around said joined structure, said pairs of resilient spacers being secured to said sleeves.

6. The plural fire damper assembly of claim 1 in which said joined structure includes at least one framing member between said first outer frames to strengthen said joined structure.

7. A plural fire damper assembly adapted for sealed mounting in a penetration through a fire resistant wall, the assembly blocking passage of fire through said penetration, said plural fire damper assembly comprising:

A. a plurality of fire dampers, each having a four sided, rectangular, sheet metal frame that is open front and back to define a circumferentially surrounded passageway for normal passage of air therethrough, there being a plurality of blades within the frame arranged to close the passageway to passage of air and fire therethrough upon melting of a link under heat of a fire, each damper having a height and a width and requiring expansion spaces along its height and width to accommodate thermal expansion of its components and insure complete closing of the passageway by the blades in the heat of a fire;

B. a first outer frame for each fire damper, each first outer frame having four sheet metal sides formed in a rectangular arrangement that is open front and back to define a circumferentially surrounded passageway therethrough, each said first outer frame having a height accommodating the height and required height expansion space of its respective fire damper and having a width accomodating the width and required width expansion space of its respective fire damper, each fire damper being installed in the passageway of its respective first outer frame with the four sides of the fire damper being juxtaposed the four sides of the first outer frame and the passageways therethrough being aligned with one another, and C. first retainer means secured to each of said first outer frames for retaining each fire damper within its respective first outer frame while blocking the passage of air and fire through the expansion spaces between the fire damper and first outer frame and accommodating expansion of each fire damper into said expansion spaces under heat of a fire;

D. said first outer frames being joined together to form a joined structure having said fire dampers in side by side rectangular arrangement, said joined structure having a height and a width and requiring expansion spaces along its height and width to accommodate thermal expansion of its components and insure complete closing of each fire damper passageway by the blades in the heat of a fire;

E. a second outer frame having sheet metal sides formed in a rectangular arrangement that is open front and back to define a circumferentially surrounded passageway therethrough, said second outer frame being adapted to be sealed in the penetration and having a height accommodating the height and required height expansion space of said joined structure and having a width accommodating the width and required width expansion space of said joined structure, the joined structure being installed in the passageway of the second outer frame with the sides of the joined strcuture juxtaposed the sides of the second outer frame and the passageways therethrough being aligned with one another, and F. second retainer means secured to said second outer frame for retaining said joined structure within the second outer frame while blocking the passage of air and fire through the expansion spaces between the joined-structure and the second outer frame and accommodating expansion of the joined structure into said expansion spaces under heat of a fire.

8. The plural fire damper assembly of claim 7 in which said first and second retainer means include members secured to said respective first and second outer frames, each said member including a base portion secured to the interior side surface of said outer frame and a barrier portion arranged to extend inwardly of said outer frame and into said outer frame passageway a distance greater than the expansion width and height provided thereat, the barrier portion having a side surface against which said fire damper and first outer frame, respectively, can slide while maintaining said respective fire damper and first frame in position along the depth of the passageways through said outer frames, said members extending around the inner circumference of said outer frames.

9. The plural fire damper assembly of claim 7 in which said first and second retainer means include angle irons.

10. The plural fire damper assembly of claim 7 including first resilient spacer means located in said height and width expansion spaces between said fire damper and first outer frame for limiting movement of said fire damper in said first outer frame otherwise induced by vibration while accommodating thermal expansion of said fire damper into said expansion sapces; and second resilient spacer means located in said height and width expansion spaces between said joined structure and second outer frame for limiting movement of said joined structure in said second outer frame otherwise induced by vibration while accommodating thermal expansion of said joined structure into said expansion spaces.

11. The plural fire damper assembly of claim 10 in which said first and second resilient spacer means include a plurality of resilient spacers, each formed from a strip of sheet metal bent into an open accordian fold and having an end mounting tab, there being a pair of resilient spacers securred in each expansion space and each resilient spacer having at least one bridge portion bridging the expansion space with the two opposed margins of the bridge portion engaging the respective fire damper and first outer frame, and the respective joined structure and second outer frame.

12. The plural fire damper assembly of claim 11 in which said first resilient spacer means include a first sleeve of sheet metal circumferentially engaged around said fire damper to reinforce said fire damper, and said second resilient spacer means include a second sleeve of sheet metal circumferentially engaged around said joined structure, said pairs of resilient spacers being secured to said sleeves.

13. The plural fire damper assembly of claim 7 in which said joined structure includes at least one framing member between said first outer frames to strengthen said joined structure.

14. A fire damper assembly adapted to be mounted in a penetration through a fire resistant wall, the assembly constructed and arranged to block passage of fire through said penetration and including vibration protection, said fire damper assembly comprising:

A. a fire damper having a four sided, rectangular, sheet metal frame that is open front and back to define a circumferentially surrounded passageway for normal passage of air therethrough, there being a plurality of blades within the frame arranged to close the passageway to passage of air and fire therethrough upon melting of a fusible link under heat of a fire, the damper having a height and a width and requiring expansion spaces along its height and width to accommodate thermal expansion of its components and insure complete closing of the passageway by the blades in the heat of a fire;

B. an outer frame having four sheet metal sides formed in a rectangular arrangement that is open front and back to define a circumferentially surrounded passageway therethrough, said outer frame adapted to be sealed in the penetration and having a height accommodating the height and required height expansion space of the fire damper and having a width accommodating the width and required width expansion space of the fire damper, the fire damper being installed in the passageway of the outer frame with the four sides of the fire damper being juxtaposed the four sides of the outer frame and the passageways therethrough being aligned with one another, C. retainer means for retaining the fire damper within the outer frame, blocking the passage of air and fire through the expansion spaces between the fire damper and outer frame and accommodating expansion of the fire damper into said expansion spaces; and D. resilient spacer means located in said height and width expansion spaces between said fire damper and outer frame for limiting movement of said fire damper in said outer frame otherwise induced by vibration while accommodating thermal expansion of said fire damper into said expansion spaces.

15. The fire damper assembly of claim 14 in which said retainer means include members secured to said outer frame, each said member including a base portion secured to the interior side surface of said outer frame and a barrier portion arranged to extend inwardly of said outer frame and into said outer frame passageway a distance greater than the expansion width and height provided thereat, the barrier portion having a side surface against which said fire damper can slide for maintaining said fire damper in position along the depth of the passageway through said outer frame, said members extending around the inner circumference of said outer frame.

16. The fire damper assembly of claim 14 in which said retainer means include angle irons.

17. The fire damper assembly of claim 14 in which said resilient spacer means include a plurality of resilient spacers, each formed from a strip of sheet metal bent into an open accordian fold and having an end mounting tab, there being a pair of resilient spacers secured in each expansion space and each resilient spacer having at least one bridge portion bridging the expansion space with the two opposed margins of the bridge portion engaging the respective fire damper and outer frame.

18. The fire damper assembly of claim 17 in which said resilient spacer means include a sleeve of sheet metal circumferentially engaged around said fire damper to reinforce said fire damper, and said pairs of resilient spacers are secured to said sleeves.

19. A fire damper assembly adapted to be mounted in a penetration through a fire resistant wall, the assembly being constructed and arranged to block passage of fire through said penetration, said fire damper assembly comprising:

A. a fire damper having a four-sided, rectangular, sheet metal frame that is open front and back to define a circumferentially surrounded passageway for normal passage of air therethrough, there being a plurality of blades within the frame arranged to close the passageway to passage of air and fire therethrough upon melting of a fusible link under heat of a fire, the damper having a height and width and requiring expansion spaces along its height and width to accommodate thermal expansion of its components and insure complete closing of the passageway by the blades in the heat of a fire;

B. an outer frame having four sheet metal sides formed in a rectangular arrangement that is open front and back to define a circumferentially surrounded passageway therethrough, said outer frame being adapted to be sealed in the penetration and having a height accommodating the height and required height expansion space of the fire damper and having a width accommodating the width and required width expansion space of the fire damper, the fire damper being installed in the passageway of the outer frame with the four sides of the fire damper being juxtaposed the four sides of the outer frame and the passageways therethrough being aligned with one another; and C. retainer means for retaining the fire damper within the outer frame, blocking the passage of air and fire through the expansion spaces between the fire damper and outer frame and accommodating expansion of the fire damper into said expansion spaces.

20. The fire damper assembly of claim 19 in which said retainer means include members secured to said outer frame, each said member including a base portion secured to the interior side surface of said outer frame and a barrier portion arranged to extend inwardly of said outer frame and into said outer frame passageway a distance greater than the expansion width and height provided thereat, the barrier portion having a side surface against which said fire damper can slide while maintaining said fire damper in position along the depth of the passageway through said outer frame, said members extending around the inner circumference of said outer frame.

21. The fire damper assembly of claim 19 in which said retainer means include angle irons.

22. The fire damper assembly of claim 19 including resilient spacer means located in said height and width expansion spaces between said fire damper and outer frame for limiting movement of said fire damper in said outer frame otherwise induced by vibration whie accommodating thermal expansion of said fire damper into said expansion spaces.

23. The fire damper assembly of claim 22 in which said resilient spacer means include a plurality of resilient spacers, each formed from a strip of sheet metal bent into an open accordian fold and having an end mounting tab, there being a pair of resilient spacers secured in each expansion space and each resilient spacer having at least one bridge portion bridging the expansion space with the two opposed margins of the bridge portion engaging the respective fire damper and outer frame.

24. The fire damper assembly of claim 23 in which said resilient spacer means include a sleeve of sheet metal circumferentially engaged around said fire damper to reinforce said fire damper, and said pairs of resilient spacers being secured to said sleeve.

25. A plural fire damper assembly including:

A. a plurality of the fire damper assemblies of claim 19 that are joined together at their outer frames to form a joined structure having said fire dampers in side by side rectangular arrangement, said joined structure having a height and a width and requiring expansion spaces along its height and width to accommodate thermal expansion of its components and insure complete closing of each fire damper passageway by the blades in the heat of a fire;

B. a second outer frame having sheet metal sides formed in a rectangular arrangement that is open front and back to define a circumferentially surrounded passageway therethrough, said second outer frame being adapted to be sealed in the penetration and having a height accommodating the height and required height expansion space of said joined structure and having a width accommodating the width and required width expansion space of said joined structure, the joined structure being installed in the passageway of the second outer frame with the sides of the joined structure juxtaposed the sides of the second outer frame and the passageways therethrough being aligned with one another, and C. second retainer means secured to said second outer frame for retaining said joined structure within the second outer frame while blocking the passage of air and fire through the expansion spaces between the joined structure and the second outer frame and accommodating expansion of the joined structure into said expansion spaces under heat of a fire.

26. The plural fire damper assmebly of claim 25 in which said joined structure includes at least one framing member between said first mentioned outer frames to strengthen said joined structure.

27. The plural fire damper assembly of claim 25 including first resilient spacer means located in said expansion spaces between said fire damper and first mentioned outer frame for limiting movement of said fire damper in said first outer frame otherwise induced by vibration while accommodating thermal expansion of said fire damper into said expansion spaces, and second resilient spacer means located in said height and width expansion spaces between said joined structure and said second outer frame for limiting movement of said joined structure in said second outer frame otherwise induced by vibration while accommodating thermal expansion of said joined structure into said expansion spaces.

28. The plural fire damper assembly of claim 27 in which said first and second resilient spacer means include a plurality of resilient spacers each formed from a strip of sheet metal bent into an open accordian fold and having an end mounting tab, there being a pair of resilient spacers secured in each expansion space and each resilient spacer having at least one bridge portion bridging the expansion space with the two opposed margins of the bridge portion engaging the respective fire damper and first outer frame, and the respective joined structure and second outer frame.

29. The plural damper assembly of claim 28 in which said first resilient spacer means includes a first sleeve of sheet metal circumferentially engaged around said fire damper to reinforce said fire damper, and said second resilient spacer means include a second sleeve of sheet metal circumferentially engaged around said joined structure, said pairs of resilient spacers being secured to said sleeves.

30. A fire damper assembly adapted to be mounted in a penetration through a fire resistant wall, which when so mounted is constructed and arranged to block passage of fire through said penetration, said fire damper assembly comprising:

A. a fire damper having a configured sheet metal frame that is open front and back to define a circumferentially surrounded passageway for normal passage of air therethrough and a plurality of blades mounted within the frame constructed and arranged to close the passageway to passage of air and fire therethrough in response to excessive elevation of temperature in the passageway, said damper configured to require perimetric expansion spaces of its configuration so as to accommodate thermal expansion thereof sufficient to insure complete closing of the passageway by the blades when said excessive elevation of temperature occurs;

B. an outer frame open front and back to define a circumferentially surrounded passageway therethrough, said outer frame adapted to be sealed in the penetration and having a preselected configuration for accommodating said perimetric expansion spaces of the fire damper, the fire damper being installed in said passageway of the outer frame with both of the passageways aligned with one another; and C. means for retaining the fire damper within said outer frame which block passage of air and fire through the perimetric expansion spaces between the fire damper and outer frame and accommodate expansion of the fire damper into said perimetric expansion spaces.

* * * * *

UNITED STATES PATENT AND TRADEMARK OFFICE

CERTIFICATE OF CORRECTION

PATENT NO. : 4,579,047

DATED : April 1, 1986

INVENTOR(S) : George E. Zielinski

It is certified that error appears in the above-identified patent and that said Letters Patent is hereby corrected as shown below:

Fig. 1, the collar surrounding duct 24 should carry the reference numeral 26 instead of 28;
Fig. 4, the sleeve comprised of sides 94a, b, c, and d should be referenced 94;
Fig. 7, reference 72c should have a lead line as in Fig. 8;
Column 5, line 5, delete "foor" and insert --foot--;
Column 5, line 41, collars "28" should be --26--;
Column 5, line 43, collars "28" should be --26--;
Column 5, line 45, collars "28" should be --26--;
Column 5, line 48, penetration "30" should be --28--;

Column 7, line 30, delete "34" and insert --94--;
Column 7, line 44, delete "intrior" and insert --interior--;
Column 8, line 28, delete "96 and insert --94--;
Column 9, line 19, after "frame" insert --156--;
Column 9, line 63, delete "spacermeans" and insert --spacer means--;
Column 9, line 66, delete "203" and insert --208--; and
Claim 7, column 13, line 51, delete "strcuture" and insert --structure--.

Signed and Sealed this

*Twenty-second* Day of *July 1986*

[SEAL]

*Attest:*

DONALD J. QUIGG

*Attesting Officer* *Commissioner of Patents and Trademarks*